United States Patent [19]

Depriest

[11] 4,427,139

[45] Jan. 24, 1984

[54] COLLAR PRESSING METHOD AND APPARATUS

[75] Inventor: Lloyd Depriest, Marshall, Ark.

[73] Assignee: Capital-Mercury Shirt Corp., New York, N.Y.

[21] Appl. No.: 297,832

[22] Filed: Aug. 31, 1981

[51] Int. Cl.[3] ..... A41H 43/00

[52] U.S. Cl. ..... 223/2; 38/15; 38/144; 273/52.1

[58] Field of Search ..... 223/2, 3, 4, 52.1, 52.6; 38/14, 15, 16, 144

[56] References Cited

U.S. PATENT DOCUMENTS

| | | | |
|---|---|---|---|
| 2,530,830 | 11/1950 | Loew | 223/2 |
| 2,619,267 | 11/1952 | Voigt | 223/2 |
| 3,501,857 | 3/1970 | Schlemon | 38/144 |
| 3,715,818 | 2/1973 | Sassman | 38/15 |

*Primary Examiner*—Louis Rimrodt
*Attorney, Agent, or Firm*—Arthur B. Colvin

[57] ABSTRACT

The present invention relates to an apparatus and method for forming collars, cuffs or like garment subcomponents, which are fabricated by stitching together a plurality of plies, inverting the stitched together plies and then pressing the inverted subcomponent to a desired finished shape. The apparatus and method are characterized by placing the pressed subcomponent, while the same still retains the heat of pressing, on a vacuum apparatus having throughgoing apertures whereby suction is exerted against the undersurface of the plies. As a result of such suction, the plies and any stiffener material interposed between the plies are maintained in a flatwise or other desired shaped condition during the colling process, whereby the desired sharp crease or fold resulting from the pressing operation is retained in the finished subcomponent.

6 Claims, 21 Drawing Figures

11
8
2
7
100
102
103
104
101
105
108
61
53
74
66
65
67
64
68
71
60
69
70
72
62
82
55
80
97
84
52
73
75
39
45
32
31
20
19
18
26
33
30
25
17
17'
44
51
95
81
54
D
C
B
12
10

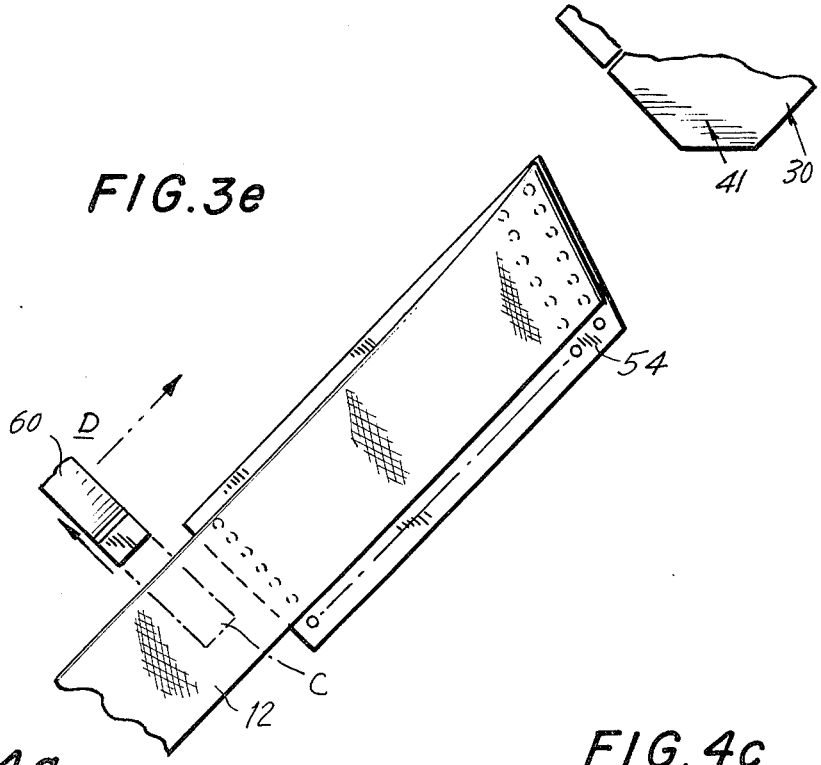
FIG. 3e
FIG. 4a
PRIOR ART
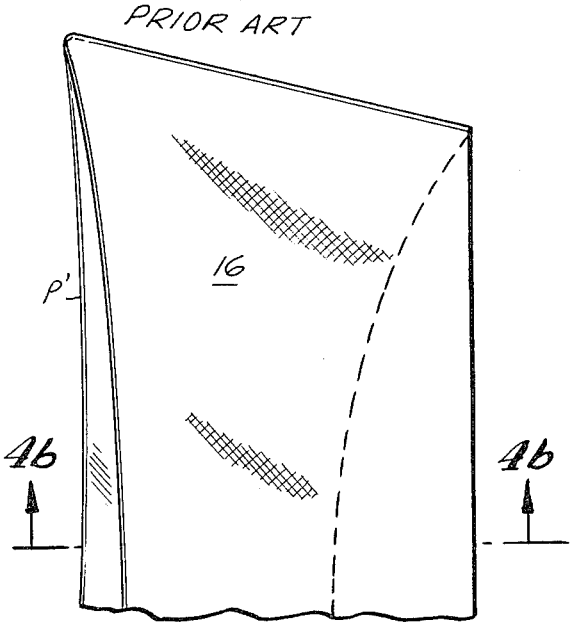
FIG. 4c
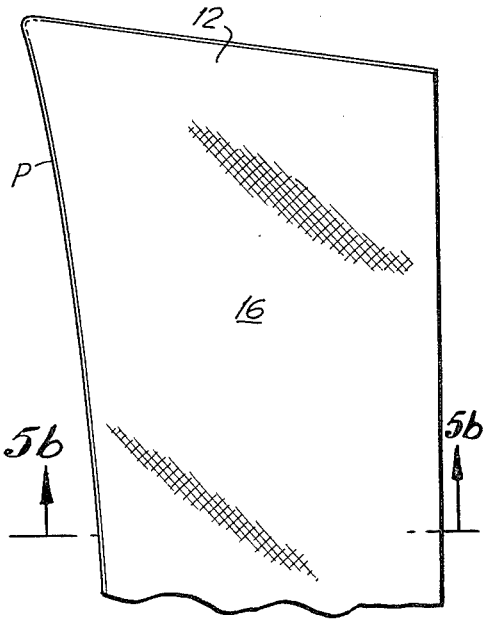
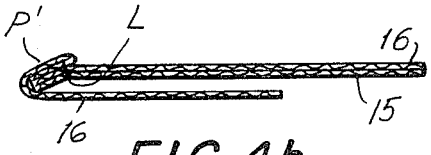
FIG. 4b
PRIOR ART
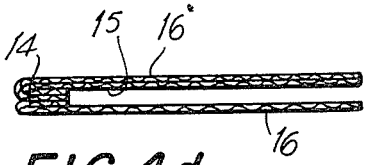
FIG. 4d

COLLAR PRESSING METHOD AND APPARATUS

BACKGROUND OF THE INVENTION

1. Field of the Invention

The present invention is in the field of Garment Forming Apparatus and Method and has for its object the provision of a method of forming collars, cuffs or like garment subcomponents, which assures that the subcomponents retain a desired configuration after pressing and the apparatus for performing the same.

2. The Prior Art

In the formation of certain garment subcomponents, illustratively collars, cuffs or the like, it is known to stitch together a plurality of superposed plies or layers of fabric together with a stiffener layer, such as buckram, which plies are relatively porous. After the layers are assembled the same are inverted, that is to say a fabric layer is inverted over the stiffener layer so as to sandwich the stiffener layer between two plies of fabric. After such inversion the stitching line initially connecting the layers defines the outer margin of the garment subcomponent positioned internally of the plies thereof. The inverted subcomponent layers are thereafter subjected to a pressing operation following which the pressed subcomponent e.g. the collar, is subjected to one or more further operations, illustratively, a stitching through the doubled-over plies adjacent the margin of the subcomponent.

As a result of the need for such further additional stitching operation mentioned above, it is highly desirable that the formed and pressed collar retain its pressed configuration. In manufacturing procedures of the type heretofore known, such as is shown in U.S. Pat. No. 2,619,267, dated Nov. 25, 1952, which pertains to an apparatus for forming and pressing collars, where the collar has a stiffener layer sandwiched between fabric plies, there is substantial tendency for the pressed article to spread or distort from its freshly pressed configuration.

SUMMARY OF THE INVENTION

The present invention may be summarized as directed to an improved method and apparatus for assuring that freshly pressed article subcomponents comprised of a multiplicity of plies, such as collars retain precisely their freshly pressed configuration, ready for a subsequent stitching operation.

In accordance with the invention there is provided a platen or support surface having a multiplicity of through going apertures formed therein and beneath which is formed a subatmospheric condition e.g. a vacuum. In accordance with the method of the invention, the freshly pressed heated article is mounted on the platen and suction is applied which draws the cooler ambient air through the article and draws the heat from the article. The effect of the air suction and cooler air flow is simultaneously to retain the article against the platen in its pressed state and remove the heat and thus cool the pressed article whereby the plies and particularly the stiffener ply is caused to precisely retain its freshly pressed configuration.

It is accordingly an object of the invention to provide a method and apparatus for treating multiple ply garment subcomponents in a manner which causes the same to set-in and dependably retain the configuration which they assumed as a result of the pressing operation. A further object of the invention is the provision of an apparatus for and a method of causing the multi-plies of a freshly pressed garment subcomponent to be retained in juxtaposed position against a forming surface illustratively a flat surface, whereby the desired freshly pressed condition is retained in the subcomponent against any tendency to bulge, roll or distort.

In order to attain these objects and such further objects as may appear herein, or be hereinafter pointed out reference is made to the accompanying drawings forming a part hereof, in which.

FIGS. 3*a* through 3*e* are fragmentary sequential plan views showing the various steps of formation of the collar from collar turning through the collar setting operation.

FIGS. 4*a* and 4*b* are plan and sectional views respectively of a prior art collar following pressing and storage for a period of time.

FIGS. 4*c* and 4*d* are fragmentary views similar to FIGS. 4*a* and 4*b* respectively of a collar made in accordance with the present invention, prior to the stitching operation.

Figure 5A:
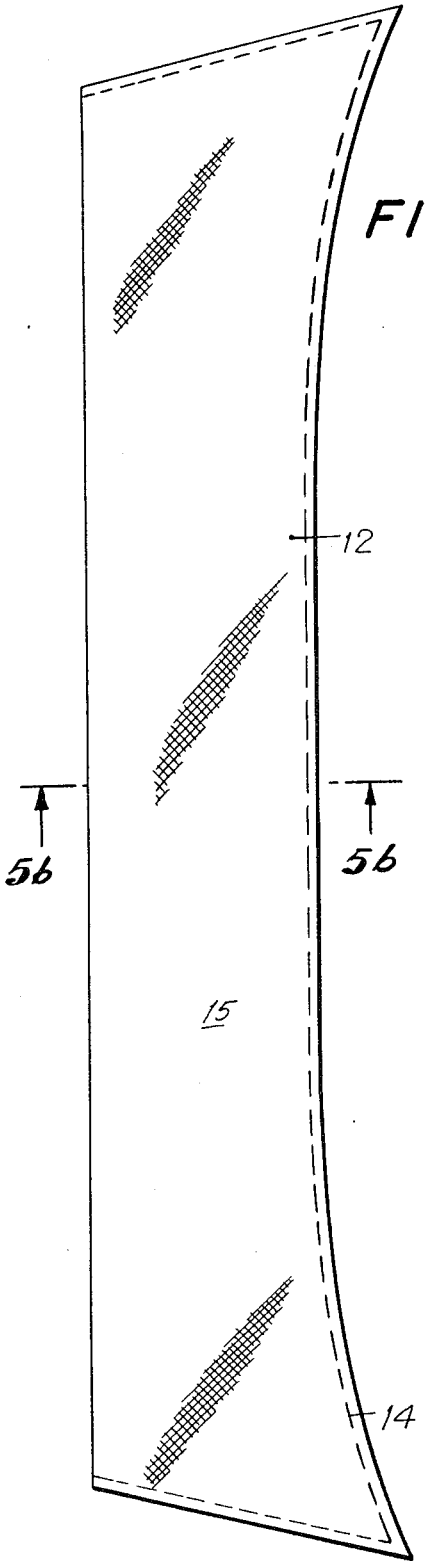
Figure 5C:
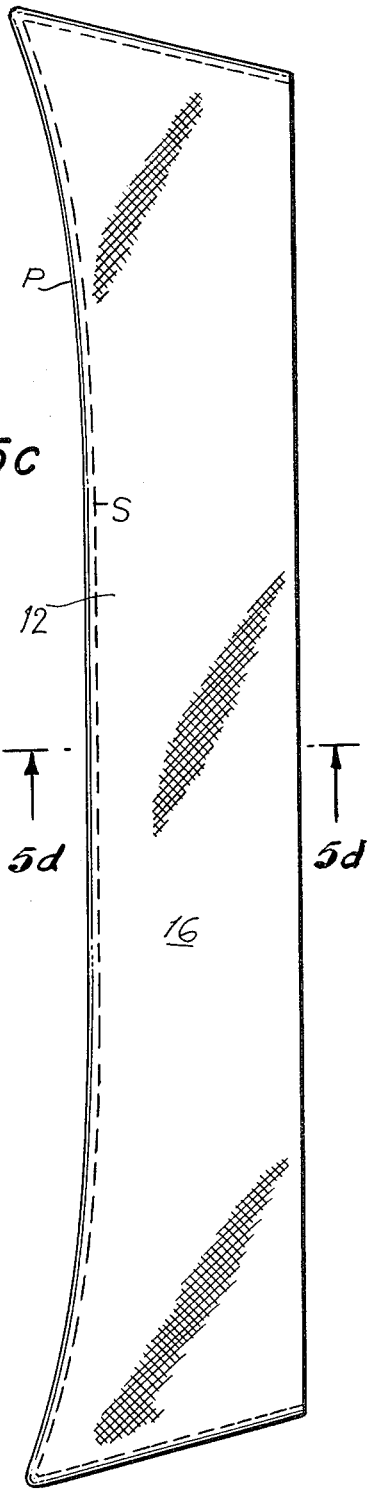
Figure 5B:
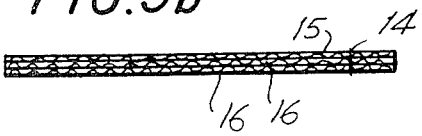

FIGS. 5*a* and 5*b* are plan and sectional views of a collar prior to pressing.

Figure 5D:
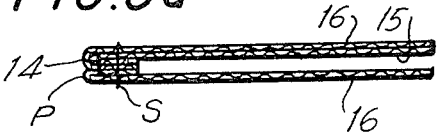

FIGS. 5*c* and 5*d* are plan and sectional views of a collar after pressing and stitching according to the invention.

Figure 6:
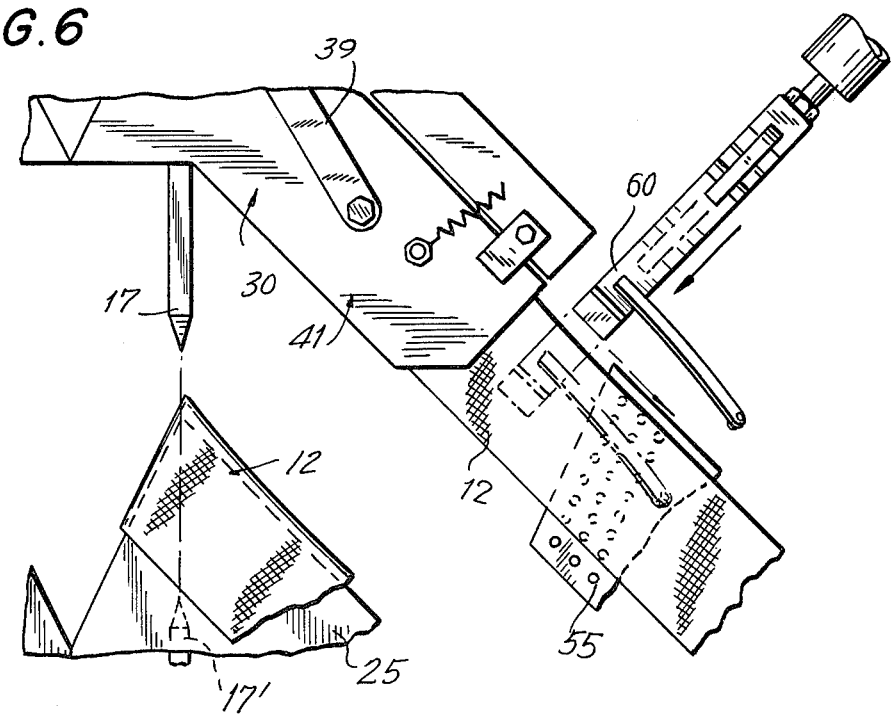

FIG. 6 is a fragmentary plan view of the apparatus for performing the finishing steps of the second side of the collar.

Figure 1:
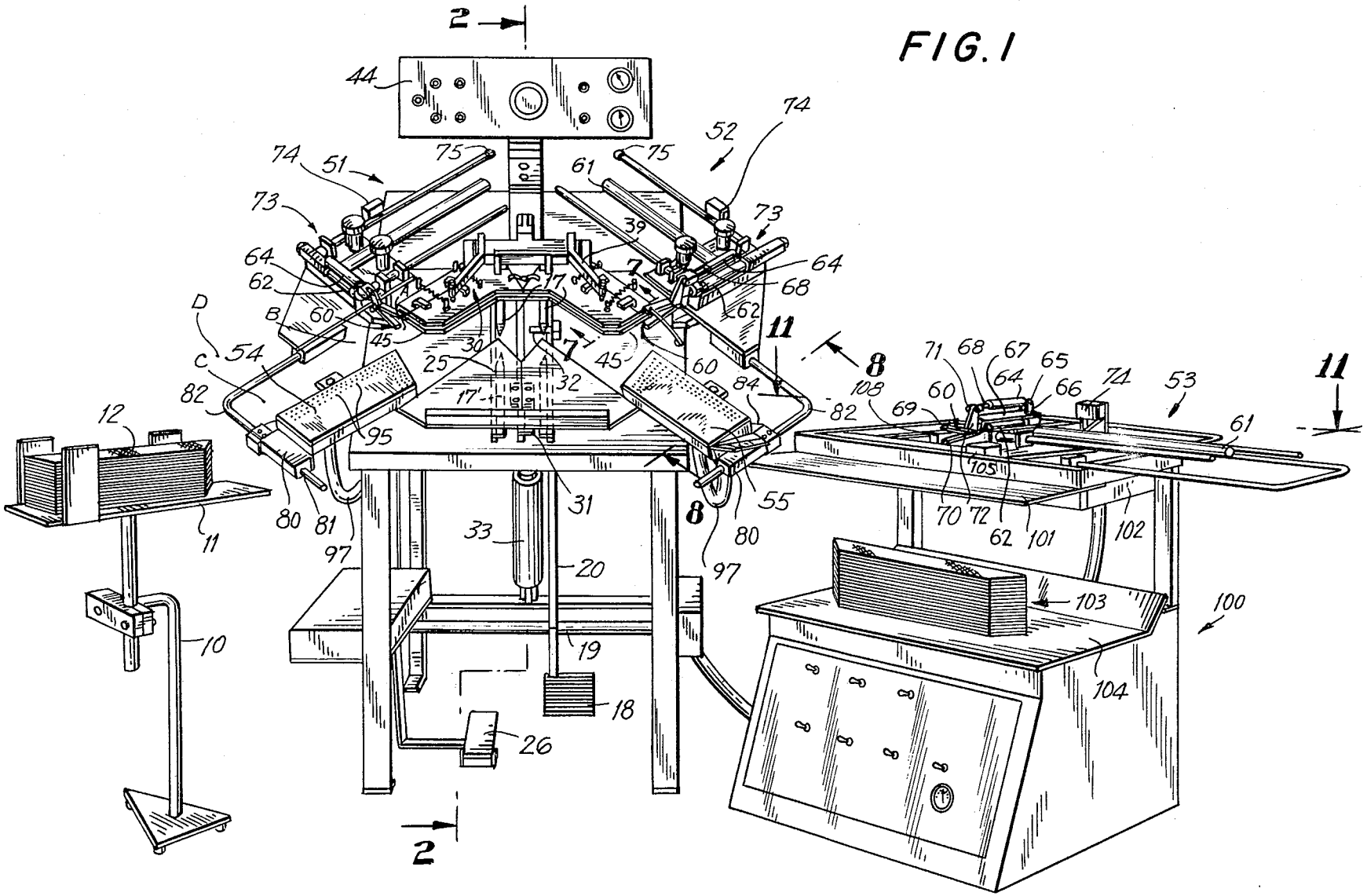
FIG. 1 is a front perspective view of a device in accordance with the invention.
Figure 7:
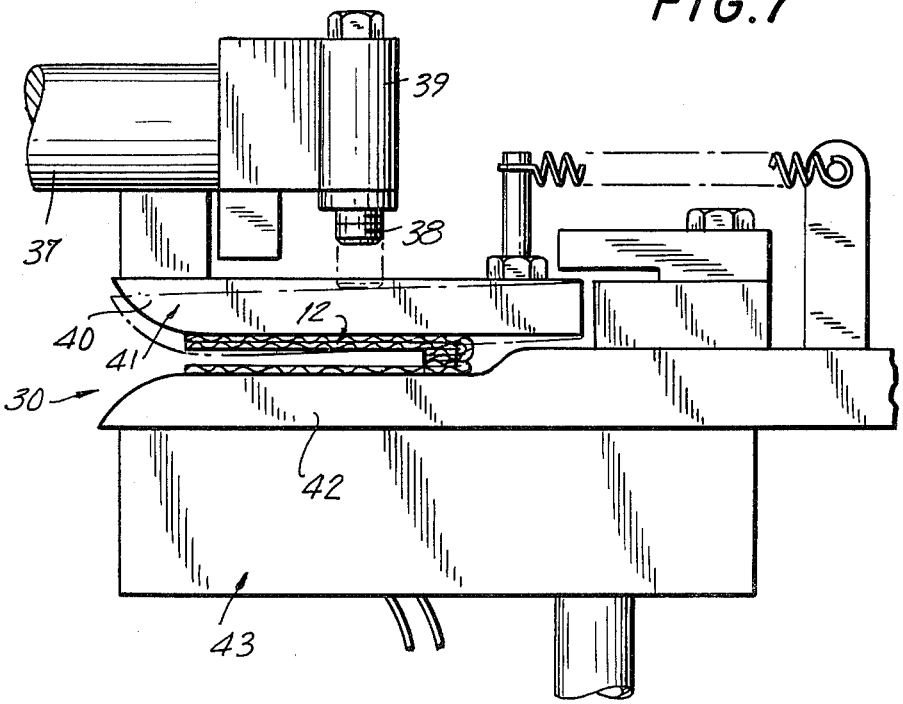

FIG. 7 is a magnified sectional view taken on the line 7—7 of FIG. 1.

Figure 8:
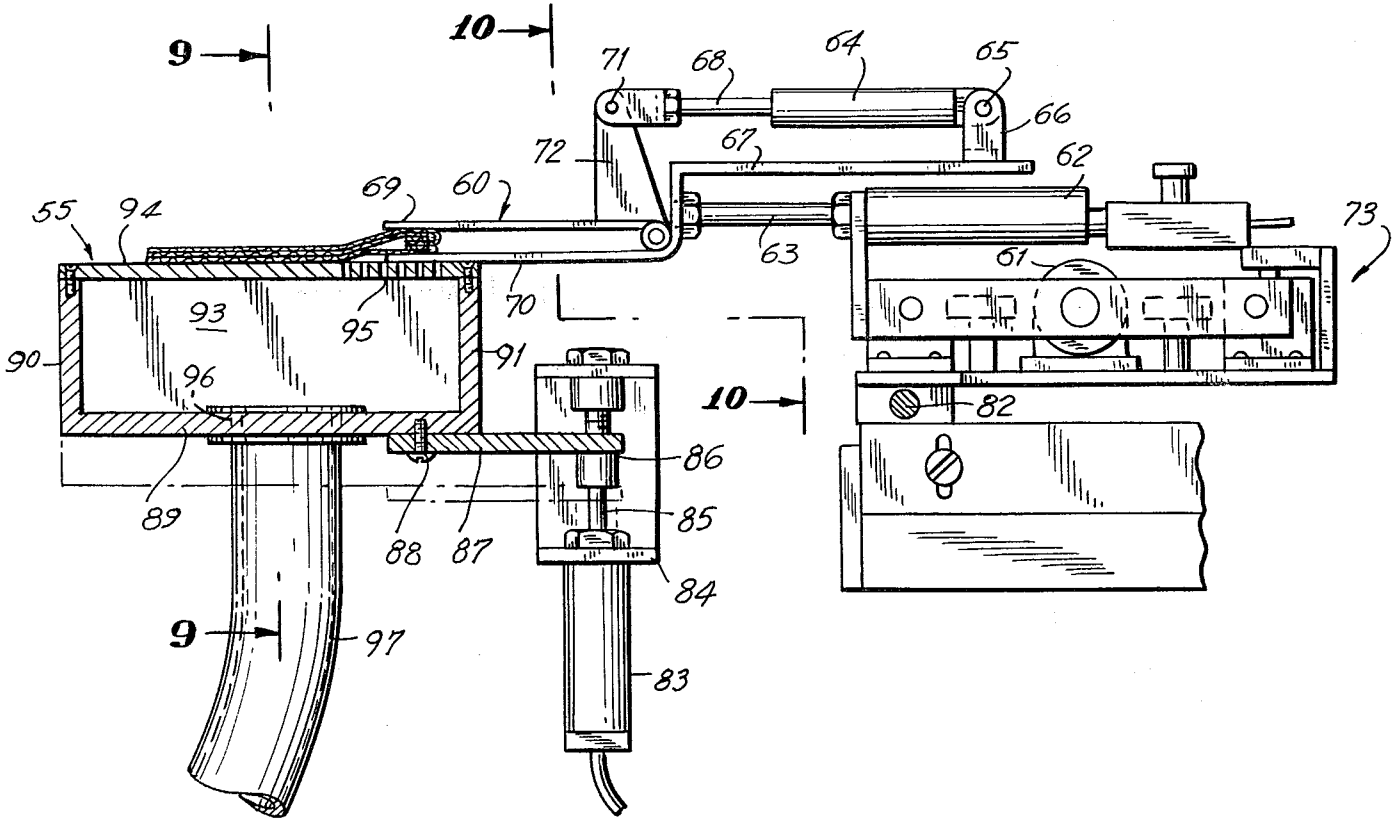

FIG. 8 is a magnified sectional view taken on the line 8—8 of FIG. 1.

Figure 9:
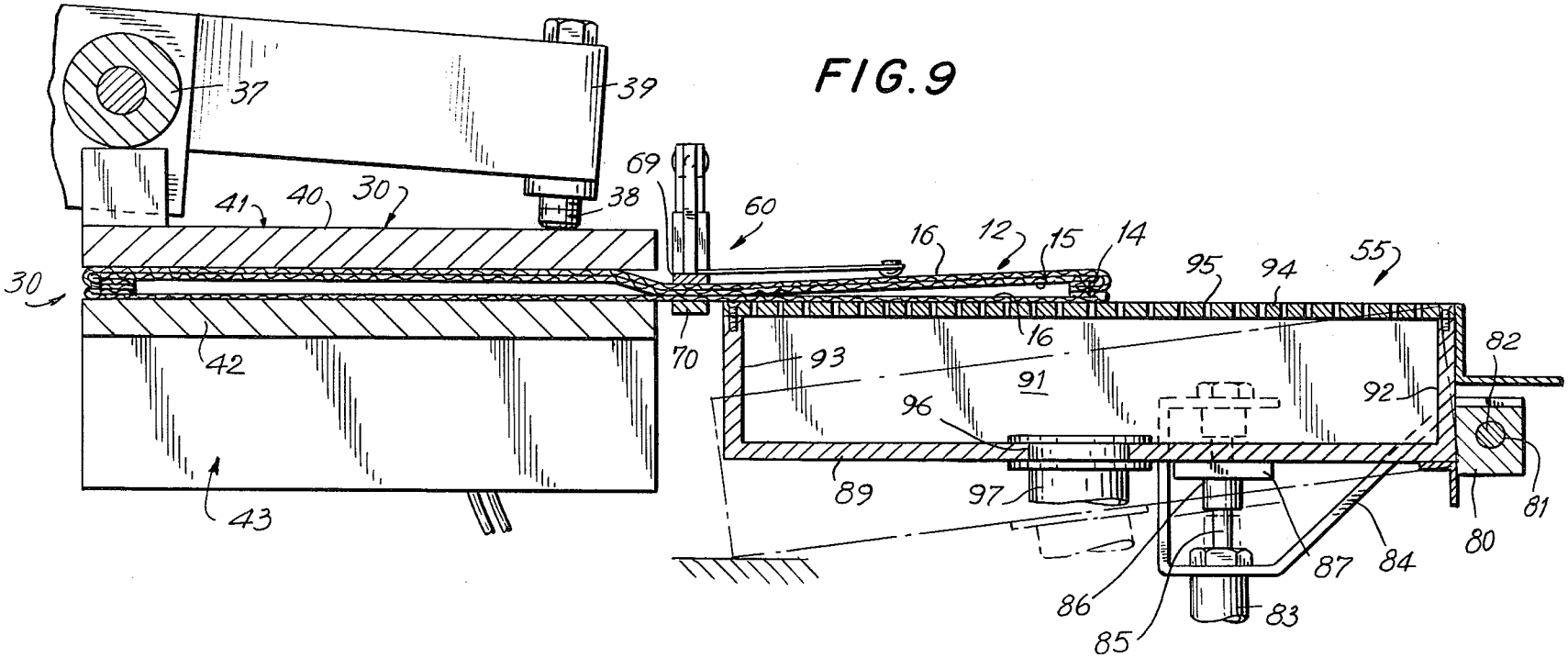

FIG. 9 is a sectional view taken on the line 9—9 of FIG. 8.

Figure 10:
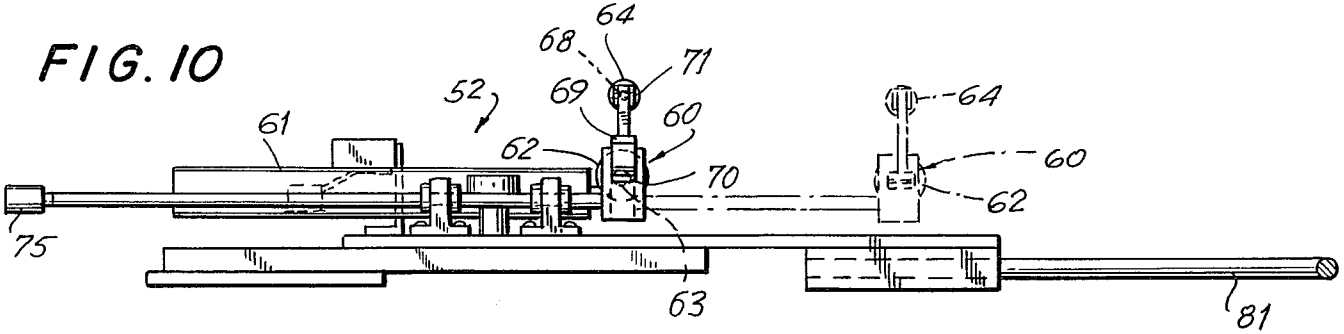

FIG. 10 is a discontinueous sectional view taken on the line 10—10 of FIG. 8.

Figure 11:
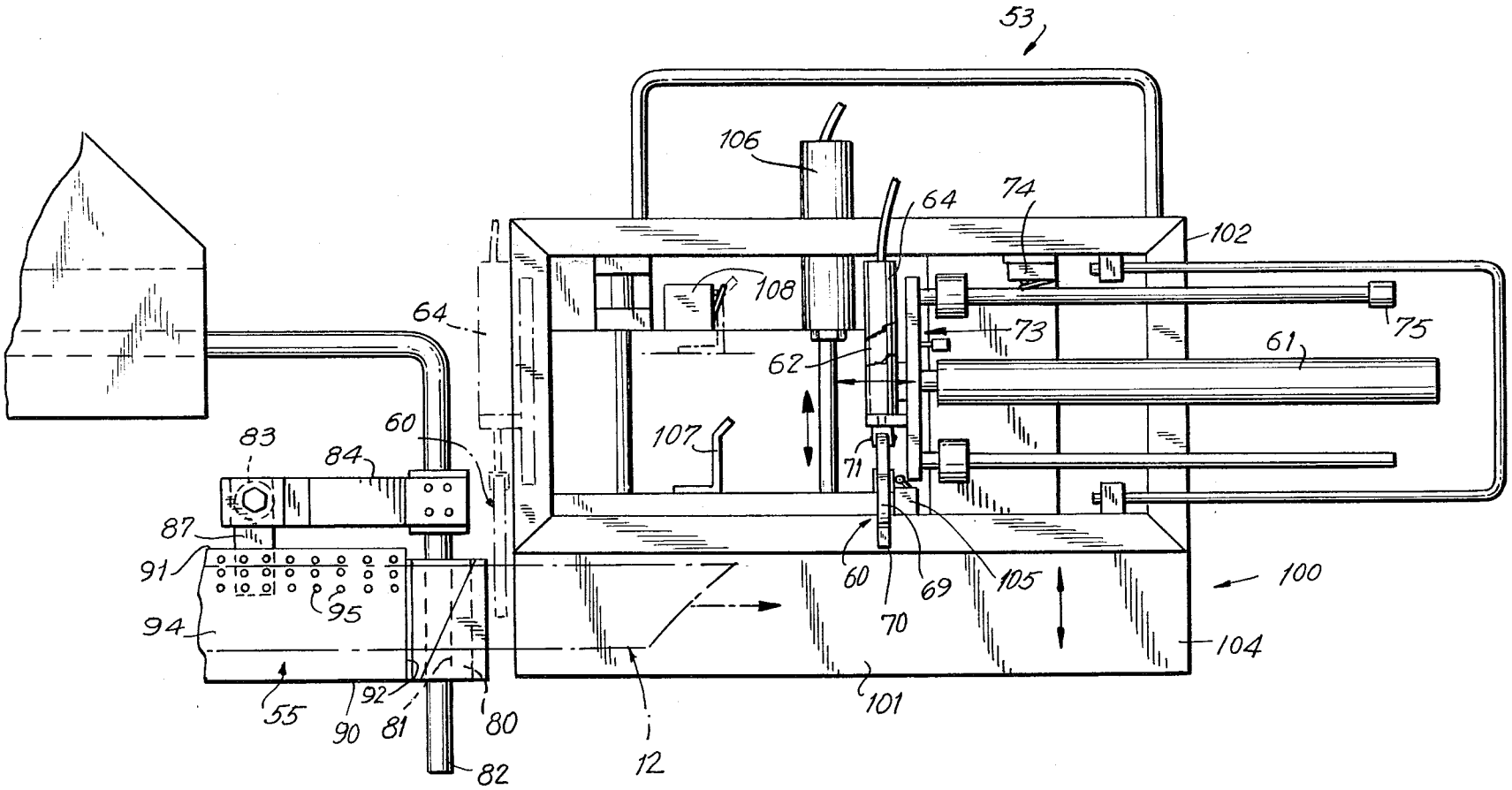

FIG. 11 is a plan view of the take-off station for the finished collar on a magnified scale, taken along the line 11—11 of FIG. 1.

Referring now to the drawings there is disclosed in FIG. 1 an overall perspective view of a collar turning and pressing apparatus in accordance with the present invention. Since the major substance of the elements of the device which enable turning of the collar points and pressing of the points are per se shown in U.S. Pat. No. 2,619,267, which patent is incorporated herein by reference, the machine, insofar as the turning and initial pressing aspects thereof, will be described only to the extent necessary to an understanding of the present invention.

In FIG. 1 there is shown a collar holder apparatus 10 in the nature of a stand having a tray portion 11 within which is disposed a supply of collar members 12, which have been sewn together as shown in FIG. 5*a* but neither turned or pressed. As is known in the art, the preformed but unpressed collars are connected together along a marginal stitch line or area 14 (FIGS. 5*a* and 5*b* ). In the preformed or unturned condition the stiffener ply 15 defines an outermost or uppermost ply (FIG. 5*b* ) and the finishing or fabric plies 16—16 are superimposed one on top of the other. As will be apparent from an inspection of FIGS. 4 and 5 and as is shown in the above cited U.S. Pat. No. 2,619,267, forming of the collar involves an initial step of inverting the plies so as to present the fabric plies 16—16 outermost and the stiffener ply 15 interiorly thereof and a subsequent step of pressing the superposed ply components to the conditions shown in FIGS. 4*d* and 5*d*.

Figure 2:
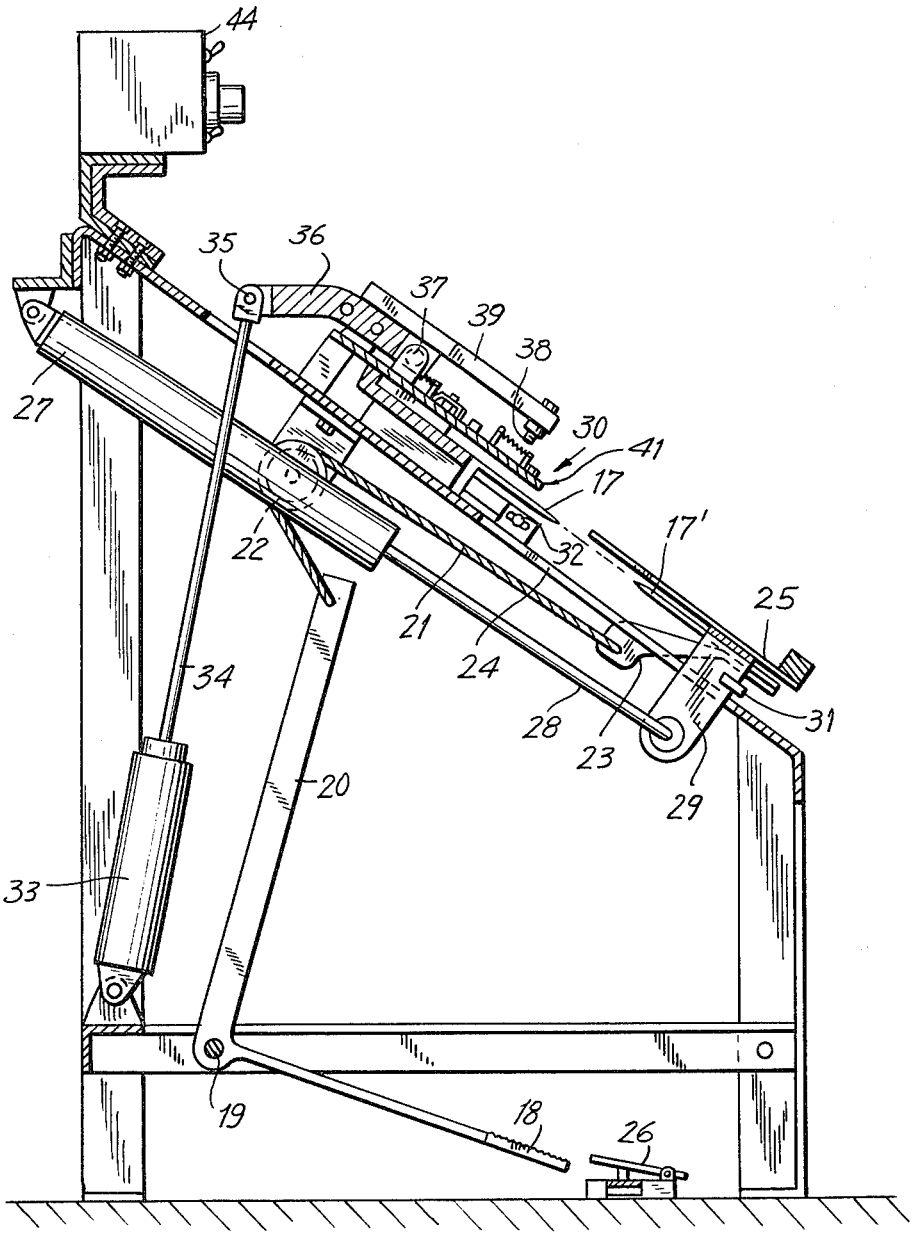
FIG. 2 is a vertical section taken in the line 2—2 of FIG. 1.

Referring again to FIG. 1, and as previously noted, the first collar forming operation involves taking a collar preform 12 (FIG. 5*a*) and placing one side of the same between the point turner members shown more specifically in FIGS. 2 and 3. The collar 12 as shown in FIG. 3*a* is placed on the first point turner 17 following which the second point turner 17' is caused to be brought into contact with the tip of the first point turner 17 carrying the collar. This action is effected by depressing foot pedal 18. Depressing foot pedal 18, which forms a part of rocker lever 20, causes the lever 20 to pivot in a clockwise direction about pivot pin 19 mounted to the machine frame. Clockwise motion of the lever 20 causes cable member 21 reeved over pulley 22 to urge carriage 23 carrying point turner 17' riding in guideway 24 toward the point turner 17 to the position shown in FIG. 3*a*. The side of the collar is now pulled back toward the operator causing the same to become inverted to assume the position shown in FIG. 4*c*. The operator next releases the mechanical foot pedal 18 whereupon the now inverted point of the collar may be shifted downwardly onto the left hand blade 25 of the collar former assembly as shown in FIG. 3*b*. The operator next depresses electrical foot switch 26 which triggers air valve mechanism (not shown) introducing air into the air cylinder 27 having a tie-rod 28 secured to carriage member 29 supporting the collar forming blades 25. The energization of the air cylinder 27 causes the forming blades to be shifted upwardly into the open pressing die assembly 30. When the operator has determined that the forming die blade enters fully into the die assembly 30 the foot switch 26 is released causing the forming blades to retract to their initial position. Spring mechanism retain the collar in position within the pressing die. Movement of the forming blades into the die assembly carries switch operator cam 31 (FIG. 2), which is mounted on the blade assembly, forwardly toward microswitch 32. The cam 31 is elongated so as to retain the microswitch in a depressed condition. After the forming blades have properly positioned the collar with the pressing die, the operator releases switch 26 resulting in retractile movement of the forming blades 25. When the forming blade carriage has moved a sufficient retractile distance, the elongate cam 31 releases the microswitch contact 32, such release activating the press cycle of the device. Activation of the press cycle introduces air into air cylinder 33 (FIG. 2) causing drive rod 34 to shift upwardly against the end 35 of rocker arm 36 pivotally mounted at point 37 causing adjustable stud 38 (FIG. 7) mounted on carrier plate 39 to be shifted downwardly against anvil portion 40 of upper pressing die plate 41 clamping the collar assembly 12 against fixed die plate 42. The fixed die plate 42 carries a heater block 43 mounted on its undersurface whereby, pressing heat is conducted to the collar 12.

The device includes a console 44 which incorporates automatic timing mechanisms adjustable for various cycles in accordance with the specific fabrics and stiffeners embodied in the collar. At the completion of a predetermined timing cycle as adjusted by the console 44 the cylinder 33 is caused to retract enabling the upper presser plate 41 to release pressure from the collar 12.

There will next be described the collar unloader mechanism which functions to remove the collar from various stations and advance the same to other stations. Three such unloaders are shown and since the same are in each instance identical a description of one will suffice. The three unloaders are specifically disclosed in FIG. 1 at 51, 52 and 53. It is the function of unloader 51 to remove a pressed collar from the first pressing station and position the same on one of the vacuum pad assemblies 54,55 forming the principal advance of the present invention and particularly assembly 54. It is the function of the second unloader 52 to remove a collar pressed at the second pressing station and position the same on vacuum assembly 55. The details of the unloader mechanisms are best shown in FIGS. 1, 8, 9 and 10. It is the function of the unloader mechanisms to move a pair of gripper fingers 60 in an essentially rectilinear path. The function of the apparatus will be described in advance of a description of the details thereof, it being understood that any alternative mechanism for moving the collar in the manner hereinafter described may be suitably substituted.

Figure 3A:
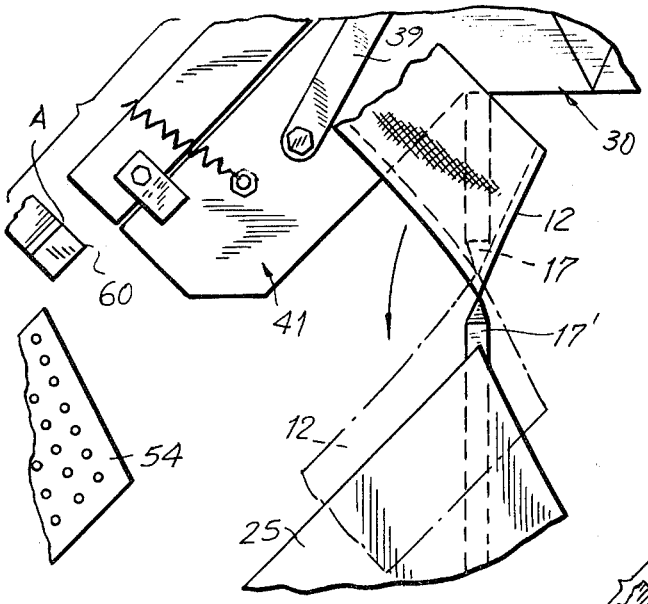
Figure 3B:
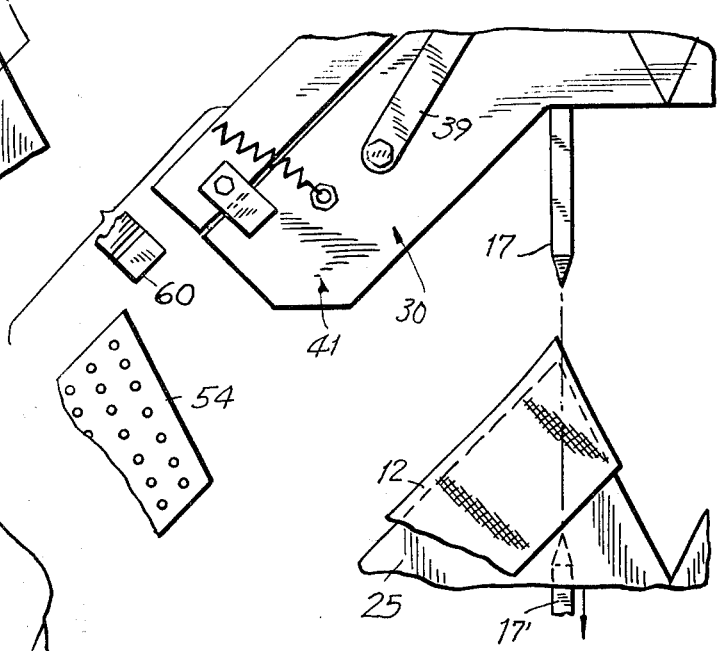
Figure 3C:
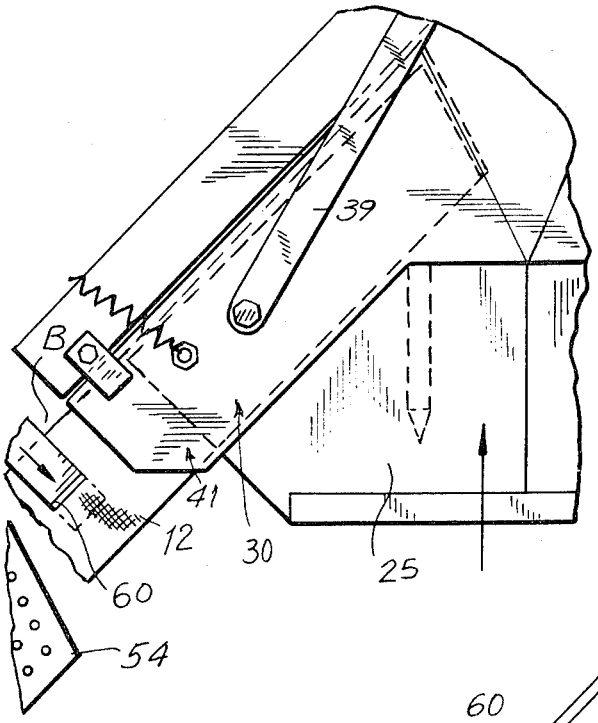
Figure 3D:
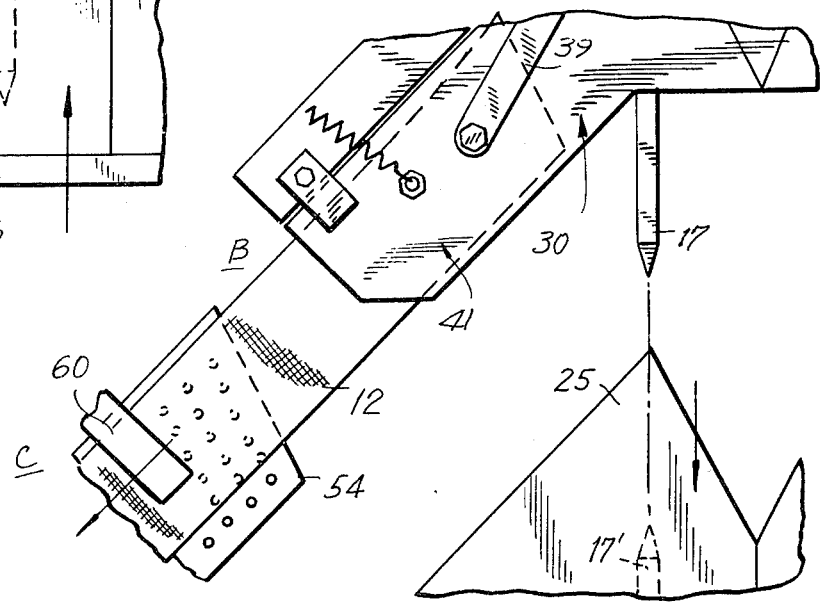

For purposes of simplicity and in view of the noncriticality of the specific mechanisms used for shifting the gripper fingers 60 in the rectilinear path noted, there is shown in FIG. 1 the four principal position occupied by the gripper fingers 60. More specifically, the fingers 60 may occupy an initial or start position A whereat the fingers are disposed in the space between the presser die assembly 30 and the vacuum assembly 54. In the position A the gripper fingers 60 are open. In the position B the fingers are disposed in immediate trailing relation to the exit 45 of the presser die 30. It will be appreciated that the fingers shift from position A to position B in an open condition and are closed upon reaching position B. In position C it will be observed that the fingers 60 have advanced a distance sufficient to dispose one end of the collar over the vacuum assembly 54. In position D the fingers have shifted transversely from the position C, so as to lie clear of the collar. It will be understood that the gripper fingers 60 are in closed position at FIG. C but open in advance of moving to position D. The A position of the gripper fingers 60 is depicted in FIG. 3*a*. In FIG. 3*c* the fingers 60 have advanced to the B position. FIG. 3*d* shows the position of the fingers and collar captured thereby at a point intermediate positions B and C. FIG. 3*e* shows the disposition of the fingers 60 is solid lines in the D position and in dotted lines in the C position.

Referring, more particularly, to FIGS. 8, 10 and 11 the actuation of the fingers 60 in the noted recilinear path is effected through three discrete air cylinders. More specifically, extension cylinder 61 and its associated piston (not shown) effect lengthwise travel, that is to say, in the direction between positions B and C on the one hand and positions D and A on the other hand. Transverse cylinder 62 and its associated piston 63 effect the transverse movements of the finger 60, that is to say, the movement of the fingers between positions A and B on the one hand and between C and D on the other hand. Opening and closing of the fingers 60 is effected by gripper cylinder 64 pivotedly mounted at 65 on bracket member 66 made fast to carrier plate 67 supported on piston 63 of the transverse cylinder 62. As will be readily recognized from an inspection of FIG. 8, outward and inward movements respectively of the piston 68 of cylinder 64 shifts movable finger 69 toward and away from fixed finger 70 of the finger assembly 60, due to the pivotal connection at 71 between the piston 68 and bell crank lever bracket 72 forming a part of the movable finger 69. As will further be observed from FIGS. 8 and 11, it will be seen that the transverse cylinder 62 forms a part of carriage assembly 73 which is extendable and retractably connected to the piston of cylinder 61.

As will be apparent to those who are skilled in the art, the respective cylinders are caused to effect their various operations in a specified sequence as a result of the activation of air or electrical switching mechanisms. Details of such mechanisms need not be supplied since the same are well within the pervue of those skilled in the art.

Referring now to FIGS. 3*c* through 3*e*, a pressed collar 12 FIG. 3*c* is shown as being removed by fingers 60 from the pressing die assembly 30 progressively to a position FIG. 3*e*, whereat the same is superposed over the vacuum plate assembly 54.

As best perceived from an inspection of FIGS. 1 and 9 the vacuum plate assemblies 54, 55 are pivotedly mounted so as to prevent their interfering with the movement of the forming blades for the collar. Additionally, the movable mounting of the vacuum assemblies permits more efficient gripping and positioning of the collar assemblies as the same are removed from the presser die.

Referring particularly to FIGS. 1, 8 and 9 the vacuum assemblies 54, 55 include a mounting block portion 80 having a generally horizontally disposed bearing aperture 81. The bearing aperture is sleeved over angle support rod 82 one branch of which is fixed relative to the frame. A vacuum pad lift cylinder 83 (FIG. 8) is mounted on bracket 84 fixed relative to the frame. The cylinder 83 includes a lift piston 85 reacting as at 86 against a vacuum support bar 87 made fast as at 88 to the vacuum assembly 54,55.

It is to be noted as shown in FIGS. 1 and 11 for example, that an end limit switch 74 is provided which will be actuated by trip member 75 at the end of the extension stroke of carriage 73 which carries the gripper fingers 60.

When switch 74 is actuated it will cause the cylinder 84 to be actuated to retract piston 85 thereof to permit downward pivoting of vaccum assemblies 54,55 as the case may be.

In addition actuation of switch 74 will actuate cylinder 64 so the clamp fingers 60 will open and will also actuate cylinder 61 so that the clamp carrier will be retracted.

The vacuum assembly 54, 55 comprises essentially a box shaped manifold which is rectangular in section including bottom wall portion 89, side wall portions 90,91, end wall portions 92,93 and top plate 94. Top plate 94 is provided with a multiplicity of through going perforations 95 which perforations preferably are concentrated on portions of the plate 94 which will support the perimetal portion P of the pressed collar, see FIG. 4*c*. The bottom wall portion 89 is provided with a through going aperture 96 coupled to hose 97 connected to a vacuum source.

From the foregoing description, it will be evident, that with the hose 97 connected to a source of vacuum, air will be drawn in through the aperture 95 to create a suction.

Referring now, specifically, to FIGS. 4*a*, 4*b* and 5*a*, 5*b* the functions and advantages of the vacuum assembly 54 will be described in greater detail. FIGS. 4*a* and 4*b* depict a prior art collar identical in structure to the collar depicted in FIGS. 4*c* and 4*d*, the sole distinction being that FIGS. 4*a* and 4*b* represent the configuration assumed by a collar fabricated in accordance with prior art methods. More specifically, in FIGS. 4*a* and 4*b* there is shown the configuration assumed by a collar processed in accordance with the apparatus of U.S. Pat. No. 2,619,267, described above.

As will be perceived, the perimetal area P′ has, after pressing, unrolled to a canted or twisted configuration. It has been discovered that the tendency of the collar to unroll or assume a biased configuration is primarily the result of a warping tendency of the stiffener layer 15 which after pressing tends to unfold about the stitch line L.

It will be readily recognized that such distortion of the collar perimeter P′ greatly complicates the succeeding collar fabricating steps, since such operations involve the formation of a further stitch line S, FIGS. 5*c* and 5*d*, which parallels and passes through all of the doubled plies formed as a result of the initial turning operation. Obviously, if the perimetal portion of the collar should buckle, as shown in FIGS. 4*a* and 4*b*, the sewing of the stitch line S is a time consuming operation and results in the fabrication of many collars which must be discarded as seconds.

There is shown in FIGS. 5*c* and 5*d* the attitude or orientations of the collar plies after the same have been pressed and have remained for a period of time on the vacuum plate 94 of vacuum assembly 54. When the collar is disposed atop the vacuum assembly 54, suction is applied to the plies of the collar which causes air to flow through such plies. The air flow mentioned serves several functions, namely to tightly press the plies of the collar against the surface of the plate 94 and draw the cooler ambient air through the plies and draw the heat from the collar which cools the collar. The simultaneous cooling and retention of the plies of the collar causes the collar components to set in the manner shown in FIGS. 5*c* and 5*d* so that a uniform peripheral edge P (FIGS. 5*c* and 5*d*) is provided.

It will readily be appreciated by those skilled in the art of collar formation that the collar construction with a uniform peripheral edge P depicted in FIGS. 5*c* and 5*d* may be readily processed with minimal likelihood of error, particularly in the formation of the sewing line S. It is further assured that the resultant collar will present a neat appearance and will maintain its press and will not tend to warp or assume a three dimensional orientation wherein the various collar plies are spaced, as shown in FIGS. 4*a* and 4*b*.

The novel vacuum setting method and apparatus hereinabove described is further advantageous, in that, by firmly holding the collar in a desired position as oriented by the transport mechanisms 51 and 52, the gripper components of the transport mechanisms may be returned to their detached or neutral position without fear of dislodging the collar from the vacuum plate.

The gripper fingers 60 further function to hold the collars against sagging in the space between the presser die 30 and the vacuum plates, whereby the level at which the collar hangs in such space in predictably established so that the operation of the gripper fingers 60 is simplified.

Optionally, there may be provided a stacking apparatus for receiving the fully pressed collars after processing in the second half section of the pressing apparatus. The stacking apparatus is shown at 100 and consists essentially of a third transport mechanism 53, the gripper fingers 60 of which function to remove fully pressed collars 12 from vacuum plate 55 and place the same upon a retractable table member 101. The table 101 may be set to retract into the base portion 102 following each pressing cycle or a series of such cycles, whereby a collar or collars deposited on the retractable component 101 will fall to the column 103 on retainer ledge 104 of the stacker.

More particularly, when cylinder 61 has retracted gripper fingers 60 (FIG. 11) to deposit finished collar on plate 101 switch 105 will be actuated to energize cylinder 106 to retract slide plate 101 to permit collar 12 to drop onto stack 103. When the plate 101 has been fully retracted, finger 107 will actuate switch 108 to energize cylinder 106 to return slide plate 101 to its original position.

The operation of the device will be apparent from the preceeding description. For start-up purposes a first collar sub-assembly inverted in the manner hereinabove set forth, is mounted on the first or left hand most forming blade, which is thereupon activated to introduce the first or left inverted side of the collar into the open pressing die. Following the pressing cycle, which acts on half the collar, the partially inverted and pressed collar is moved to the vacuum station 54, whereupon it is set in the manner set forth. Thereupon the semi-formed collar is removed from vacuum station 54 and the opposite or unturned collar point is placed on the right hand most collar inverting station and inverted as above described. The right hand inverted portion of the collar is then mounted on the other forming blade, which is thereafter actuated to introduce the second or right inverted side of the collar into the now open pressing die. Following the pressing cycle of the right side of the collar it is moved to the vacuum station 55 where it is also set in the manner set forth. Following start-up in the manner noted, the fabricating is continuous and a single operator is enabled to efficiently and rapidly process a multiplicity of collars, all of which retain the precise pressed shape as a result of the setting influences of the vacuum apparatus.

As will be evident to a skilled worker in the art familiarized with the preceeding description, numerous variations in details of construction may be effected without departing from the principles of the invention. More particularly, while the method and apparatus of the present invention have been described in conjunction with a collar turning and pressing apparatus of the type shown in the U.S. Pat. No. 2,619,267, it will be evident that the same may be readily adapted for use with any collar turning and pressing device, whether the device functions to form one point at a time as is the case with the above referenced patent, or whether both points are simultaneously formed.

Moreover, while the device has been described in conjunction with a fixing or forming method for collars, it will be evident that the same may be used in the formation of cuffs and like units which are conventionally manufactured by initially sewing several plies together along all but an inner edge thereof, following which the multi-ply unit is inverted or turned inside out and pressed to shape, to condition it for further processing operations or for securing to the finished garment.

In view of the numerous variations of mechanical structure in which the invention is susceptible of being employed it is intended the same is to be broadly construed within the scope of the appended claims.

The embodiments of the invention in which an exclusive property or privilege is claimed are defined as follows:

1. The method of forming a pressed collar blank for the attachment to a shirt or the like from a collar preform which includes congruent first and second fabric plies and a stiffener ply, said fabric plies being superposed over said stiffener ply and being sewn together along a margin-adjacent stitch line connecting three edges defining the free edge and the transverse edges of the collar, which comprises the steps of inverting one of said fabric plies over the other of said plies to encompass said stiffener ply between said pair of fabric plies, whereby said stitch line is encompassed by said free and transverse edges, subjecting said inverted plies to heat and pressure, thereby to flatten said plies, and thereafter, and while said plies remain heated as a result of said heating step, applying a gripper to said plies to transport said plies, transporting said plies to the surface of an air pervious platen, while supporting said plies on the surface of said platen, applying suction through said platen against the plies thereon, to bias said plies against said platen by said suction and to draw the heat therefrom and retaining said plies on said platen subjected to such suction until said collar blank is set in said flattened condition, and stacking said collar blank.

2. The method in accordance with claim 1 wherein said suction is produced by causing a subatmospheric pressure condition to exist on the side of said platen remote from said surface.

3. The method in accordance with claim 1 wherein suction is induced against the areas of said plies adjacent said stitch line whereby ambient air is drawn through said plies to cool the latter to enhance the setting action.

4. The method of forming a heat pressable garment component such as a collar having a plurality of superposed plies of fabric sewn together along a stitch line adjacent a margin of said component to define a main portion and a selvage portion, said selvage portion being sandwiched between said superposed plies, comprising the steps of subjecting said plies to heat and pressure thereby to press said component to a desired configuration and thereafter, and while said plies are at an elevated temperature as a result of said heating step, transporting said plies using a gripper to the surface of a perforate platen, disposing said plies on the surface of said perforate platen while simultaneously inducing a suction against the undersurface of said plies through said perforate platen to urge said plies against said platen to permit setting of said plies, and stacking said plies.

5. Apparatus for forming a pressed collar blank from a collar preform having congruent first and second fabric plies and a stiffener ply, said fabric plies being superposed over said stiffener ply, said plies being sewn together along a stitch line proximately spaced from the border of said plies and connecting three edges defining the free edge and the transverse edges of the collar, the portions of said plies between said stitch line and border forming selvage portions, the collar preform having points defined by the junction of said transverse edges with said free edge, said apparatus including means for inverting one said fabric ply over the said stiffener ply, thereby to encompass said stiffener ply between said fabric plies, whereby said stitch line is disposed between said fabric plies, pressing means for subjecting said inverted collar preform to heat and pressure thereby to flatten said plies and selvage, a platen member having a support surface positioned to receive at least portions of the undersurface of said pressed collar preform, said platen member including a plurality of throughgoing apertures, and vacuum means for applying suction through said apertures of said platen member against the undersurface of said collar preform, thereby to urge said collar preform against said support surface, said platen defining the upper surface of an enclosure and said enclosure being connected to a source of subatmospheric pressure to create such suction, said pressing means having an outlet and gripper means positioned adjacent said outlet and movable to said platen, means to actuate said gripper means to engage a preform in said pressing means and position said preform on said platen, and means to actuate said gripper means to release said preform when it is positioned on said platen and to return said gripper means to said outlet, said suction retaining said preform on said platen when said gripper means is actuated to release said preform.

6. Apparatus in accordance with claim 5 in which a stacker mechanism is provided adjacent a platen, said stacker mechanism having a retractable receiving plate, gripper means associated with said stacker mechanism, means to effect movement of said gripper means from alignment with said plate to juxtaposition with said platen, means to actuate said gripper means to engage a preform on said platen and to move said gripper means and said preform to said plate for discharge thereon and means to retract said plate to drop said preform to form a stack.

* * * * *